US006918663B2

(12) United States Patent
Schaschek et al.

(10) Patent No.: US 6,918,663 B2
(45) Date of Patent: Jul. 19, 2005

(54) METHOD FOR INSERTING IMAGES ON PRINTING PLATES

(75) Inventors: Karl Erich Albert Schaschek, Thüngen (DE); Georg Schneider, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/240,736

(22) PCT Filed: Feb. 22, 2001

(86) PCT No.: PCT/DE01/00697

§ 371 (c)(1),
(2), (4) Date: Oct. 10, 2002

(87) PCT Pub. No.: WO01/78984

PCT Pub. Date: Oct. 25, 2001

(65) Prior Publication Data

US 2003/0085972 A1 May 8, 2003

(30) Foreign Application Priority Data

Apr. 14, 2000 (DE) ..... 100 18 547

(51) Int. Cl.[7] ..... B41J 2/01; B41M 5/00
(52) U.S. Cl. ..... 347/101; 101/463.1; 101/465
(58) Field of Search ..... 347/101, 105; 428/195, 32.1; 101/463.1, 465, 466

(56) References Cited

U.S. PATENT DOCUMENTS 3,951,060 A 4/1976 Crystal
4,003,312 A 1/1977 Gunther
4,430,379 A * 2/1984 Hayakawa et al. ..... 428/216
5,312,654 A * 5/1994 Arimatsu et al. ..... 427/511
5,417,164 A * 5/1995 Nishida et al. ..... 101/453
5,487,338 A 1/1996 Lewis et al.
5,655,446 A * 8/1997 Watanabe ..... 101/128.21
5,677,108 A 10/1997 Chia et al.
5,820,932 A * 10/1998 Hallman et al. ..... 427/261
5,992,322 A * 11/1999 Fromson et al. ..... 101/457
6,182,569 B1 * 2/2001 Rorke et al. ..... 101/457
6,245,421 B1 * 6/2001 Aurenty et al. ..... 428/304.4
6,447,884 B1 * 9/2002 Burberry et al. ..... 428/32.39
6,474,235 B2 * 11/2002 DeBoer et al. ..... 101/465
6,588,340 B2 * 7/2003 Friedman ..... 101/467

FOREIGN PATENT DOCUMENTS

DE 24 56 539 A1 7/1975
JP 10119230 A 5/1998

* cited by examiner

*Primary Examiner*—Lamson Nguyen
*Assistant Examiner*—Leonard Liang
(74) *Attorney, Agent, or Firm*—Jones Tullar & Cooper PC

(57) ABSTRACT

A printing plate is prepared for the insertion of images by applying an ink accepting layer and an ink repelling layer to it. A developing fluid is sprayed onto the ink repelling layer by an ink jet printing group. The developing fluid is sprayed in the image to be printer and the ink repelling layer is etched or dissolved in the sprayed area. The etched or dissolved areas of the ink repelling layer are removed. The method is particularly adapted for use with a waterless printing plate having an ink repelling layer of silicon.

5 Claims, 1 Drawing Sheet

METHOD FOR INSERTING IMAGES ON PRINTING PLATES

FIELD OF THE INVENTION

The present invention is directed to a method for applying images on printing plates.

BACKGROUND OF THE INVENTION

Various methods are known for placing images on planographic or offset printing plates. In one method, photosensitive plates are exposed to lasers and thereafter are developed in accordance with a wet-chemical process. The prior art also shows so-called thermo-plates, wherein a linkage of the uppermost layer is achieved by the use of laser energy, and the process that is triggered in this way, is brought to a close in a further step. Another arrangement was selected in connection with so-called thermally ablative plates. There, an absorbent intermediate layer is caused to evaporate by a laser, whereupon the ink-repellent layer above it is dissolved and can be removed in a subsequent step. In this context, see U.S. Pat. No. 5,487,338.

It is also known to place an image on a printing plate by applying a suitable fluid. In accordance with U.S. Pat. No. 4,003,312, a silicon solution, corresponding to the image to be printed, is sprayed on a printing plate substrate and is cured. By this process, the required surface structure of the printing plate is created. However, processing of the silicon layer to be sprayed on is difficult. Added to this is the difficulty in the curing of the sprayed-on silicon layer.

JP 10-119 230 A discloses a method for producing a printing plate. The ink-absorbent layer, i.e. the layer of this printed plate to be imprinted, is located on the water-absorbent layer. To produce the plate, the ink-absorbent layer is sprayed with an image-forming material by use of an inkjet. The areas not to be imprinted become water-soluble.

SUMMARY OF THE INVENTION

The object of the present invention is directed to providing a method for applying images to printing plates.

In accordance with the present invention, this object is attained by providing a printing plate having an ink-absorbent layer and an ink-repellent layer placed on it. An inkjet printing unit is used to apply a developing fluid to the ink-repellent layer to define the image to be printed. The ink-repellent layer in this area is changed and the changed areas of the ink-repellent areas are removed.

The advantages which can be attained by the present invention reside, in particular, in that a developing fluid, corresponding to an image to be printed, is applied to the ink-repellent layer with an inkjet printing unit. The ink-repellent layer is loosened or dissolved in the sprayed area, and the loosened or dissolved areas of the ink-repellent layer are removed.

Thus, by spraying or imprinting the uppermost layer by use of the inkjet printing unit, the uppermost layer is directly stripped off, or is loosened or dissolved to such an extent that it can be stripped off. The properties of the ink-repellent layer are changed by the developing fluid in such a way that this layer can be easily removed in the areas imprinted with the developing fluid. The areas not imprinted with the developing fluid remain on the printing plate, so that the desired surface structure is achieved. The ink-absorbent layer is exposed in the areas from which the ink-repellent layer has been removed, so that the printing plate is provided with ink-absorbent areas corresponding to the image to be printed and with the remaining areas being ink-repellent. The developing fluid can be precisely applied, droplet by droplet, with the aid of the inkjet printing unit.

Substantial advantages are achieved by the direct loosening or dissolving of the surface of the printing plate in accordance with the present invention. A higher degree of dependability of the inkjet method is achieved. In particular, the drying of the ink known with the conventional methods is prevented. The print head often became gummed up when spraying the silicon solution, or when applying light-repellent printing inks for the photographic development of the printing plates in accordance with the prior processes. This made extensive cleaning necessary, or even made the print head completely unusable. In contrast to these prior methods, the developing fluid used with the present invention cannot gum up the print head of the inkjet printing unit.

Moreover, further steps for then processing the printing plate such as, for example, the curing of the sprayed-on silicon or synthetic resin solution, or the customary photographic development of photosensitive layers following fixation of the areas not to be removed, are omitted in the use of the method for applying images in accordance with the present invention.

In a particularly advantageous manner, it is now possible, in connection with the application of images on a printing plate in accordance with the present invention, to do without the clean room conditions in the printing press, which had to be adhered to in connection with the known prior art methods. No material is applied in the present method. Material is only removed.

It is possible, in principle, to employ various printing plates in the present invention. However, a waterless printing plate, with an ink-repellent layer of silicon, is preferably used. Various layers are considered as ink-absorbent layer, which withstand the action of the developing fluid used to remove the ink-repellent layer. It is possible, in particular, to provide a polyethylene foil, which is placed under the silicon layer, as the ink-absorbent layer.

The developing fluid to be used is matched to the ink-repellent layer to be loosened or dissolved. A solvent is used in particular, by the use of which, the respective areas of the ink-repellent layer are liquefied. It is then possible to remove the silicon layer, in a particularly simple manner, from the loosened areas in a subsequent step.

Several methods can be considered for removing the loosened or removed areas of the ink-repellent, top layer of the printing plate. For example, the loosened or dissolved areas of the ink-repellent layer can be removed with the first printing ink, or mechanically by use of a suitable cleaning unit. The loosened or dissolved area of the top layer of the printing plate are preferably removed by mechanical stresses on the printing plate, in particular by a printing process. Because of this, the required process steps for the image application are minimized, and an efficient, as well as a simple, image application on the printing plate is achieved, in accordance with the present method.

In place of the above-described loosening or dissolution and removal of the ink-repellent layer, it is also possible, in principle, to print an ink-absorbing top layer with developing fluid in the manner described above by use of an inkjet printing unit and in this way to loosen and to dissolve and remove the ink-absorbing top layer. In this case, areas of the ink-repellent layer located underneath the top, ink-absorbing layer are exposed. However, preferably a printing plate with a top, ink-repellent layer, in particular made of silicon, is used in the above-described manner, which top, ink-repellent layer of the printing plate is removed in areas corresponding to the image to be printed.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
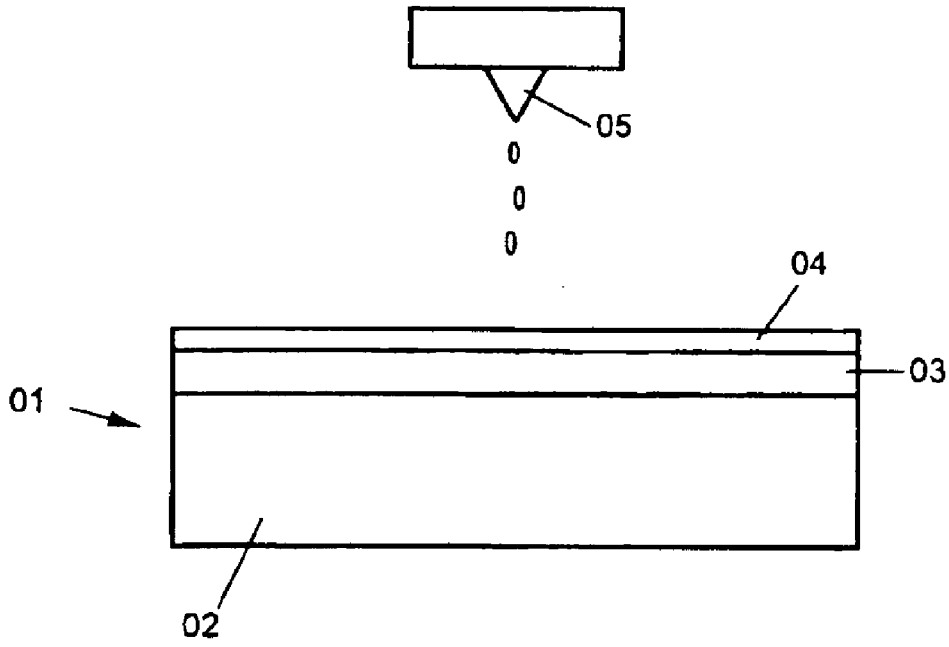
FIG. 1, a schematic representation of a printing plate in the unprocessed state prior to the application of developing fluid by use of a print head, in accordance with a preferred embodiment of the present invention, and in FIG. 2, a schematic representation of the printing plate in FIG. 1 after the application of the image.

Referring initially to FIG. 1, there may be seen a printing plate, generally at 01, to which an image is to be applied in accordance with the present invention. The printing plate 01 represented in FIG. 1 has a support layer, or substrate 02, which can be made of aluminum and which has a sufficient thickness for obtaining the desired mechanical properties. An ink-absorbent layer 03, as well as an ink-repellent layer 04 lying on top of the ink-absorbent layer 03 have been placed on support layer 02. The ink-absorbent layer 03 can be embodied as a polyethylene foil. Its thickness can lie in the range between 5 to 50 $\mu$m, preferably it can have a thickness of approximately 20 $\mu$m. The ink-repellent layer 04 preferably consists of silicon. It thickness is suitably selected. It can lie in the range of a few $\mu$m, in the embodiment shown it is approximately 2 $\mu$m. An adhesive or base layer can be placed between the substrate 02 and the ink-absorbent layer 03. A titanium oxide layer is provided in the preferred embodiment shown in FIG. 1.

A waterless printing plate, which is a product of the firm Presstek (PearlDry), is preferably used in connection with the present invention. This plate is described in U.S. Pat. No. 5,487,338, to which specific reference is made in connection with the structure of the printing plate.

In order to loosen, or to remove, the silicon, ink-repellent layer 04 area-wise in accordance with the image to be printed, a solvent is applied, droplet by droplet, as the developing fluid to the surface of the silicon layer 04 by use of a print head 05, as schematically represented in FIG. 1, of an inkjet printing unit. The control of the print head 05 takes place in a manner which is customary for inkjet printers. The solvent, which will be applied in accordance with, and in the area of the image to be printed, liquefies the silicon in those areas to which it has been applied, so that the silicon can be easily removed from these areas. Instead of liquefaction of the silicon, ink-repellent layer, only a change in the properties of the silicon layer 04, for example by swelling, or by a reduction of the adhesion of it to the layer underneath it, can take place. The loosened silicon layer 04, or its loosened areas, can be removed with the first ink applied to the plate 01, or by the use of a suitable cleaning unit. It is advantageous that the loosened silicon is present as a liquid. The liquefied silicon can be removed by the mechanical stresses imparted to the plate 01 during the printing process, in particular.

Figure 2:
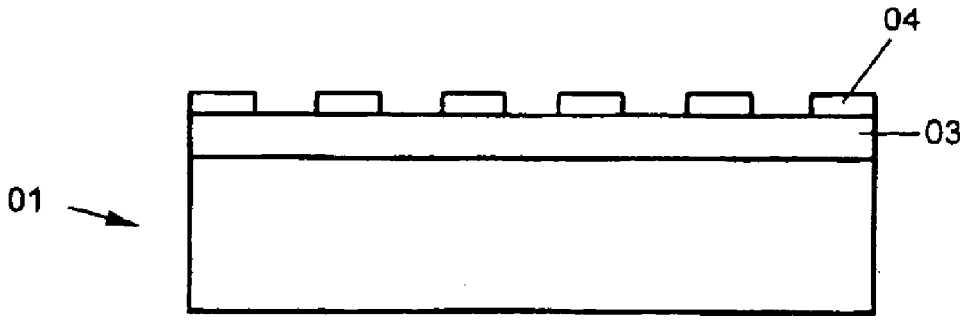

The finished printing plate, with the images applied and with the areas of the silicon layer 04 removed, is depicted in FIG. 2. The printing plate 01 is brought into contact with printing ink, which only adheres to the ink-absorbent polyethylene layer 03, i.e. to the areas from which the silicon layer 04 was removed. The ink images applied to the ink absorbing portions of the printing plate are transferred to the carrier, such as to the paper web, to be imprinted.

What is claimed:

1. A method for forming images on a printing plate including:

providing a printing plate having a surface;

providing an ink-absorbant layer on said surface of said printing plate;

providing an ink-repellant layer on said ink-absorbant layer and overlying said ink-absorbant layer;

providing an inkjet printing unit;

using said inkjet printing unit and applying a developing fluid to areas of said overlying ink-repellant layer;

defining an image to be printed as said areas of said ink-repellant layer contacted by said developing fluid;

using said developing fluid for changing said overlying ink-repellant layer in said areas of said overlying ink-repellant layer contacted by said developing fluid;

removing said changed overlying ink-repellant layer, in said areas of said ink-repellant layer contacted by said developing fluid applied by said ink jet printing unit, from said ink-absorbant layer on said surface of said printing plate in accordance with said image to be printed; and exposing said ink-absorbant layer on said surface of said printing plate in said areas defining said image to be printed during removal from said areas of said changed overlying ink-repellant layer from said printing plate.

2. The method of claim 1 further including providing said printing plate as a waterless ink offset printing plate having an ink-repellant layer of silicone.

3. The method of claim 2 further including selecting a developing fluid and using said selected developing fluid for liquefying said ink-repellant layer.

4. The method of claim 1 further including selecting a developing fluid and using said selected developing fluid for liquefying said ink-repellant layer.

5. The method of claim 1 further including removing said changed layer by subjecting said printing plate to mechanical stresses.

* * * * *